US005979916A

United States Patent [19]

Gatel et al.

[11] Patent Number: 5,979,916

[45] Date of Patent: Nov. 9, 1999

[54] IN-LINE ROLLER SKATE

[75] Inventors: Bernard Gatel, Renage; Pierre Gignoux, Le Sappey En Chartreuse, both of France

[73] Assignee: Skis Rossignol S.A., Voiron, France

[21] Appl. No.: 08/887,712

[22] Filed: Jul. 3, 1997

[30] Foreign Application Priority Data

Jul. 15, 1996 [FR] France ..... 96 09037

[51] Int. Cl.[6] ..... A63C 17/02

[52] U.S. Cl. ..... 280/11.22; 280/11.28

[58] Field of Search ..... 280/11.2, 11.27, 280/11.28, 11.23; 301/5.3, 5.7

[56] References Cited

U.S. PATENT DOCUMENTS

| | | | |
|---|---|---|---|
| 3,339,936 | 9/1967 | Hamlin . | |
| 5,232,231 | 8/1993 | Carlsmith . | |
| 5,299,185 | 3/1994 | Sakurai et al. | 369/75.2 |
| 5,503,413 | 4/1996 | Belogour . | |
| 5,513,862 | 5/1996 | Chuang | 280/11.22 |
| 5,823,543 | 10/1998 | Burns et al. | 280/11.22 |
| 5,890,724 | 4/1999 | Gignoux et al. | 280/11.28 |

FOREIGN PATENT DOCUMENTS

| | | | |
|---|---|---|---|
| 8602796 | 6/1988 | Netherlands . | |
| 2 160 780 | 1/1986 | United Kingdom | 280/11.2 |
| 93/12847 | 7/1993 | WIPO | 280/11.28 |
| 93/14840 | 8/1993 | WIPO | 280/11.28 |

OTHER PUBLICATIONS

Descender, Ski Chalet in–line skates by Rossignol, InterNet; http://skichalet.com/Skates/Rossignol, Dec. 1998.

RAPS Axle Clap Frame, Special Equipment Co., InterNet; http://www.specialequipment.com/frames.htm, Dec. 1998.

*Primary Examiner*—Robert J. Oberleitner
*Assistant Examiner*—Daniel Yeagley
*Attorney, Agent, or Firm*—Bugnion S.A.; John Moetteli

[57] ABSTRACT

A skate is provided, consisting of an upper chassis (3) which supports a boot (4) and which is articulated onto a lower chassis (1) provided with rollers (2), about a pin (5) located in the front half of the lower chassis. The upper chassis (3) is elastically supported. The inclination of the upper chassis (3) can be modified using an adjustment device with prepositioning, comprising a wedging part and a prepositioning member (12) that arms a spring whose relaxation brings the wedging part into the desired position when it is released by the upper chassis. A relatively weak actuation spring is sufficient.

5 Claims, 5 Drawing Sheets

FIG. 1
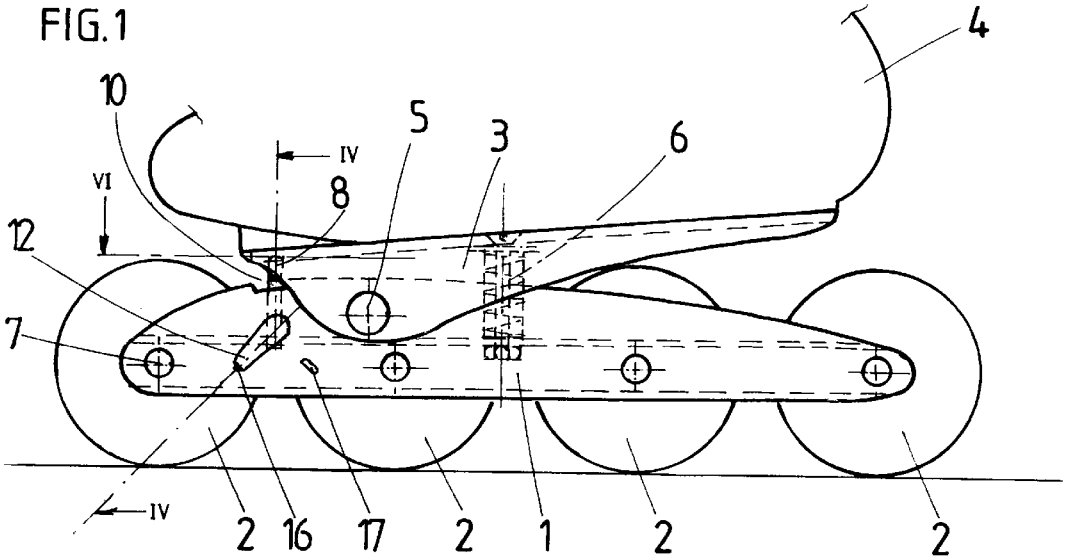
FIG. 2
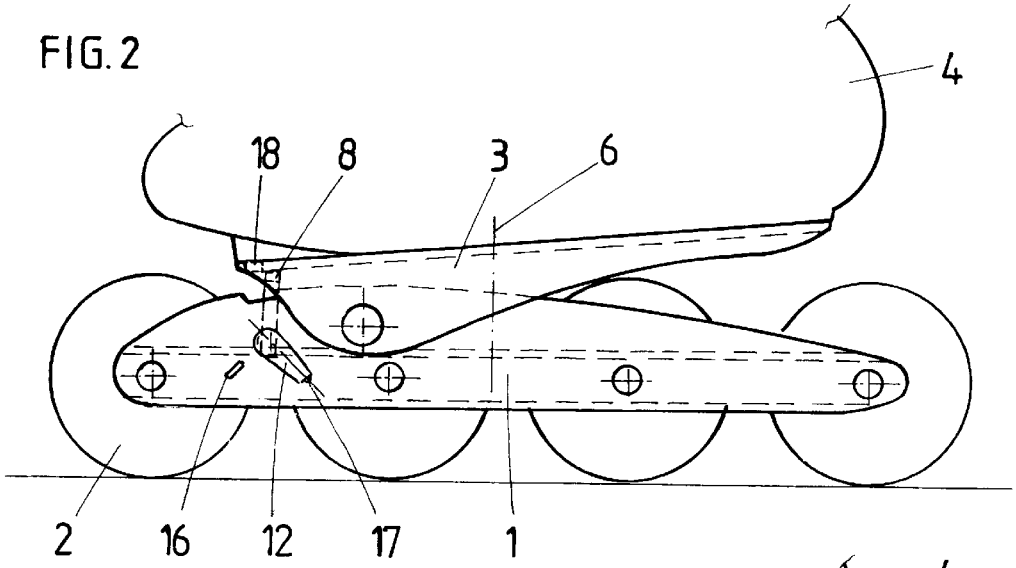
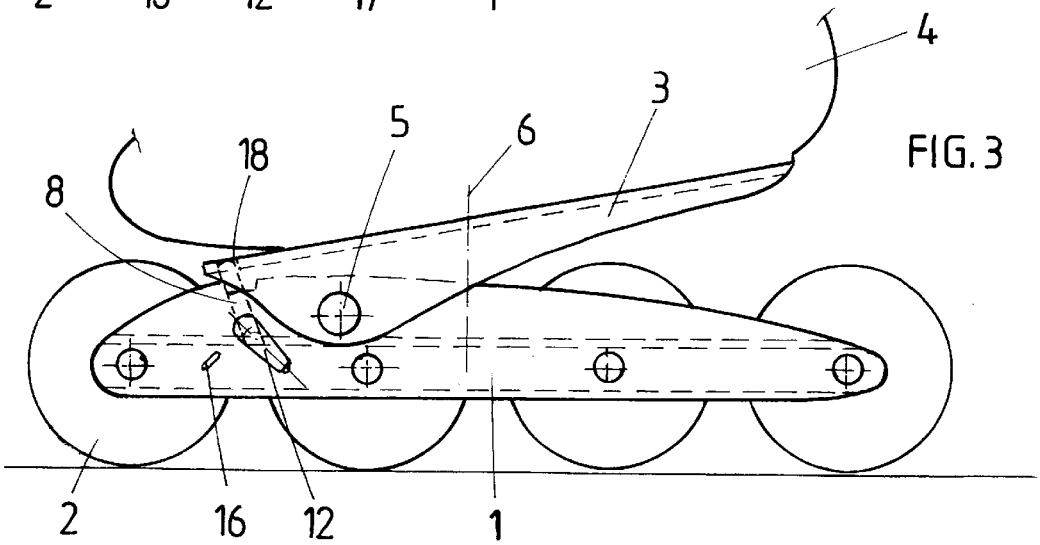
FIG. 3

FIG.8
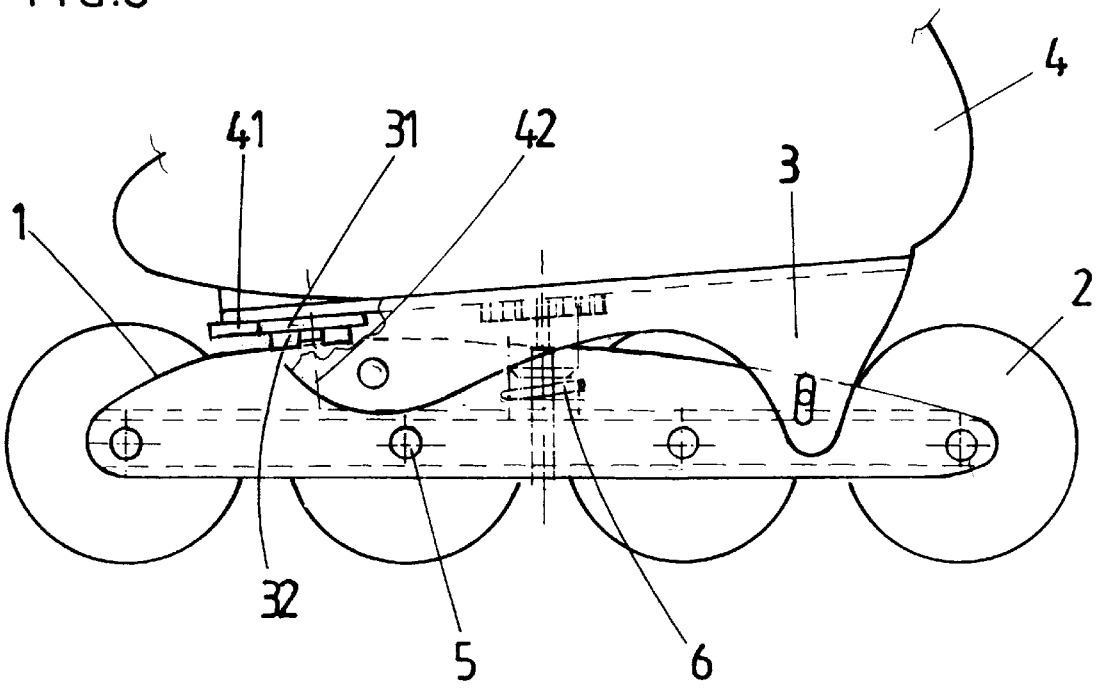
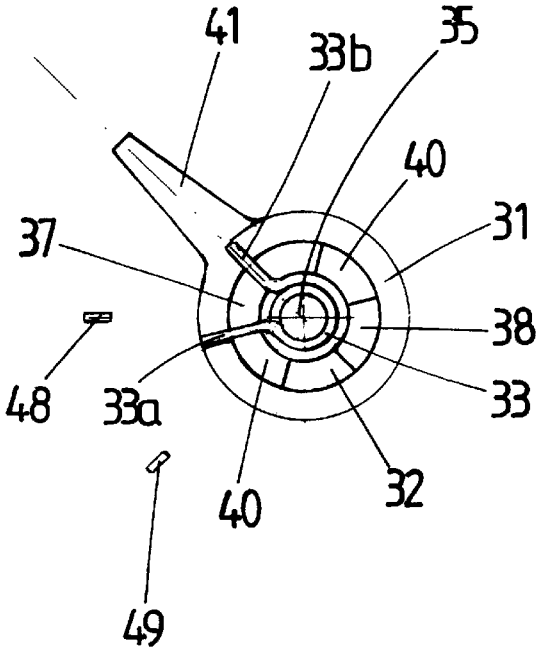
FIG.9

IN-LINE ROLLER SKATE

FIELD OF THE INVENTION

The present invention relates to an in-line roller skate comprising an upper chassis on which a boot is fixed, and a lower chassis which bears at least two rollers and onto which the upper chassis is articulated about a pin parallel to the axles of the rollers and located between and including the middle and the front end of the lower chassis, and an elastic means which counteracts the downward movement of the upper chassis and is located between the two chassis.

PRIOR ART

GB patent 2,160,780 discloses a roller skate having an upper chassis which is articulated to the middle of a lower chassis provided with two rollers and equipped with an arm pressed by a spring counteracting the rearward tilting of the upper chassis. The tilting of the upper chassis is intended to brake the rear roller.

U.S. Pat. No. 3,339,936 discloses a skate with two in-line rollers, the boot of which is carried by a platform fixed exclusively and rigidly to the front of the chassis of the skate, so that the chassis constitutes an arm working in flexion in order to allow the rear of the platform to be lowered with a view to braking the rear roller.

In the unpublished patent application EP No. 96 810 909.0 the Applicant Company describes skates having an upper chassis articulated in the front part of a lower chassis fitted with rollers, these skates being further equipped with an elastic means working in compression or torsion to counteract the rearward tilting of the upper chassis. This elastic element also acts as a damper and thus provides particular comfort for the skater. By returning the energy stored when it is compressed, it also provides a complementary thrust during skating. In the top position, the upper chassis has a relatively pronounced forward inclination. However, an inclination of this type is unsuitable for playing hockey or for skating aggressively and forcefully. In order to allow a skate to be used in various ways, it would therefore be desirable to modify the maximum inclination of the upper chassis, the hardness of the damper being, of course, also adjustable. The obvious solution for modifying the inclination of the upper chassis consists in putting a wedge between the upper chassis and the lower chassis. However, to do this, it is still necessary to overcome the force of the spring of the damper or of the torsion bar. Action of this type requires a considerable force, which makes the adjustment operation difficult.

SUMMARY OF THE INVENTION

The object of the present invention is to provide a solution to this problem, and more precisely to produce an inclination adjustment device which is very easy to operate.

The skate according to the invention is one which includes in front of the articulation pin of the two chassis, a device for adjusting the maximum inclination of the upper chassis, this device consisting of a wedging member capable of occupying at least two different wedging positions, at least one spring for positioning the wedging member, having delayed action, and a manual prepositioning means, actuation of which causes arming of the said spring so long as the wedging member is retained by one of the chassis, so that the wedging member is brought into the prepositioned position by the relaxation of the positioning spring when it is released by the compression of the said elastic means under the effect of the skater's weight.

The positioning of the wedging member takes place only when it is released, this positioning can be carried out by a small spring which is armed by the control member without any particular effort. As for the force needed to release the wedging member, this is provided by the skater's weight, the hardness of the elastic means providing suspension for the upper chassis also being in general adjustable as a function of this weight.

BRIEF DESCRIPTION OF THE DRAWINGS

The appended drawing represents, by way of example, three embodiments of the skate according to the invention.

FIG. 1 represents a first embodiment, with the upper chassis of the skate being in the bottom position, the elastic suspension means being highly compressed and the control member being in the locking position.

FIG. 2 represents the same skate in the same position, but with the control member in the position which releases the upper chassis.

FIG. 3 represents the same skate after the locking stop has been released.

FIG. 8 represents a third embodiment.

FIG. 9 is a bottom view of the wedging member of the third embodiment.

DESCRIPTION OF THE PREFERRED EMBODIMENTS

Figure 4:
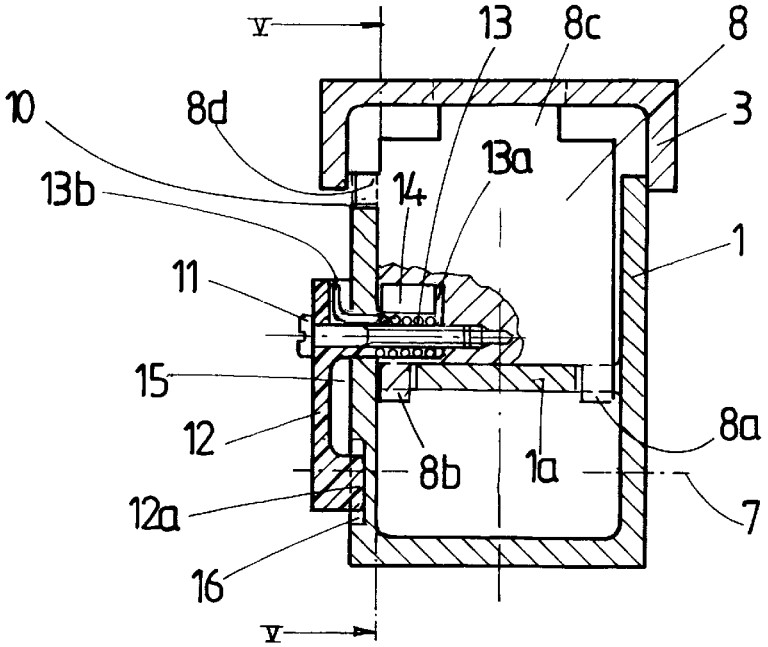
FIG. 4 is a view in section on IV—IV in FIG. 1, but without the boot or the rollers.
Figure 5:
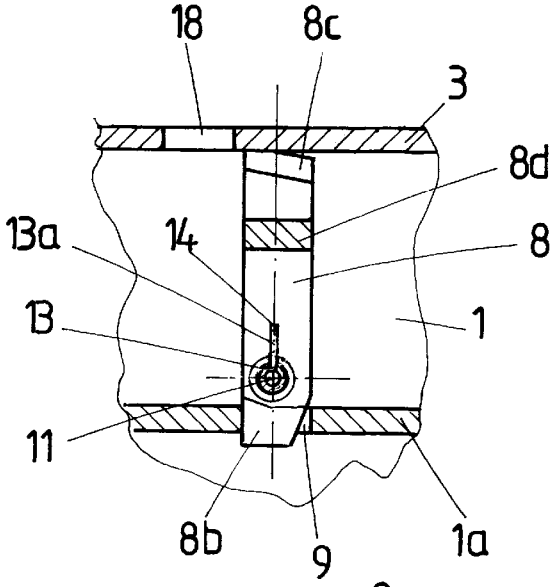
FIG. 5 is a partial view in section on V—V in FIG. 4.
Figure 6:
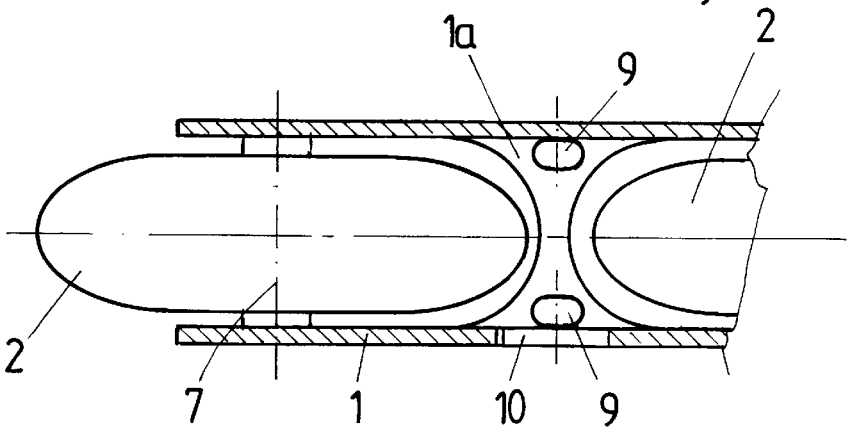
FIG. 6 is a partial view in section of the lower chassis on VI—VI in FIG. 1.

The skate represented in FIG. 1 comprises a lower or main chassis 1 equipped with four in-line rollers 2, and an upper chassis 3 forming a platform on which a boot 4 is fixed. This upper chassis 3 is articulated onto the lower chassis 1 about a pin 5 located above and slightly in front of the second roller, counting from the front of the skate. Behind the pin 5, the upper chassis 3 is supported on the lower chassis 1 by a spring 6 working in compression along axis 6' (shown in FIG. 2 and 3). As can be seen in FIG. 4, the lower chassis 1 consists of a partly tubular extruded section having a horizontal transverse bridge 1*a* between two vertical walls, this bridge being cut out to allow passage for the rollers, as shown by FIG. 6. FIG. 4 represents the axle 7 of the front roller. The upper chassis 3 consists of a U-shaped section whose flanks fit on either side of the lower chassis 1.

In the position represented in FIG. 1, the upper chassis 3 is held in the slightly inclined bottom position by a stop 8 in the form of a plate, which extends substantially vertically and is mounted so as to pivot in the lower chassis 1. The stop 8 bears on the bridge 1*a* and is provided with two retention stubs 8*a* and 8*b* engaged with clearance in oblong holes 9 formed in the bridge 1*a*. The stop 8 supports the upper chassis 3 via a part 8*c* which is narrower than the body of the stop. This stop 8 also has a lateral lug 8*d* engaged in a recess 10 made in the upper edge of the lower chassis 1, the ends of which recess serve as stops limiting the travel of the stop 8 when it tilts. A screw 11 is screwed into the thickness of the stop 8, parallel to the plane of the plate which it forms, which screw constitutes the pivot pin of the stop and retains a manual repositioning means 12. The manual repositioning means 12 is a control lever 12 made of synthetic material which is mounted so as to rotate on the screw 11. A torsion spring 13 is mounted around this screw and has one end 13*a* engaged in a groove 14 formed in the thickness of the stop 8, and its other end 13*b* engaged in a groove 15 formed in the lever 12. Two grooves 16 and 17 are formed in the side of the lower chassis 1, which grooves constitute positioning notches for the lever 12 which engages in these notches via a projection 12*a*.

In the position represented in FIGS. 1 and 4, the lever 12 is engaged in the notch 16 in such a way that the torsion spring 13 is slightly armed in torsion in the clockwise direction in FIG. 1, and the lug 8*d* of the stop 8 abuts against the rear edge of the recess 10. The edge of the stop 8 bears against the platform of the upper chassis 3 and this chassis is held in the slightly inclined position. In this position, the spring 6 is generally highly compressed, so that the two chassis 1 and 3 behave substantially as a single chassis equipped with a damper.

When the skater decides to increase the inclination of the upper chassis, it is sufficient for him to remove the lever 12 from the notch 16 and rotate it to the right to bring it into the notch 17. This operation is made possible by the flexibility of the lever 12. The stop 8 is retained by the upper chassis 3 under the strong thrust of the spring 6, and the torsion spring 13 is armed so that it is ready to push the stop in the counterclockwise direction. The stop 8 is thus prepositioned.

By pressing his weight on the heel, the skater compresses the spring 6 further, which has the effect of releasing the stop 8 which tilts forward under the thrust of the spring 13 until it comes to abut against the front end of the recess 10. In this position, the narrow part 8*c* of the stop 8 can engage in a clearance hole 18 in the upper chassis 3, thus allowing the upper chassis 3 to pivot forward, as represented in FIG. 3. The stop 8 is held in this position by the spring 13 and the upper chassis 3 assumes a more inclined position.

In order to return to the position represented in FIG. 1, it is sufficient to bring the lever 12 into the notch 16, which has the effect of arming the spring 13 and compressing the spring 6 enough to allow the stop 8 to tilt into the position represented in FIG. 1 under the effect of the spring 13.

There are many possible variants for the embodiment which is described. In particular, the lever 12 could be replaced by a button. The plate 8 could be in the form of a cam. The torsion spring 13 could be replaced by a vertical leaf which works in flexion around an intermediate support and one end of which is engaged in the stop, the other end being engaged in the control member. In the latter case, the lever 12 could be replaced by a part that slides horizontally.

Figure 7:
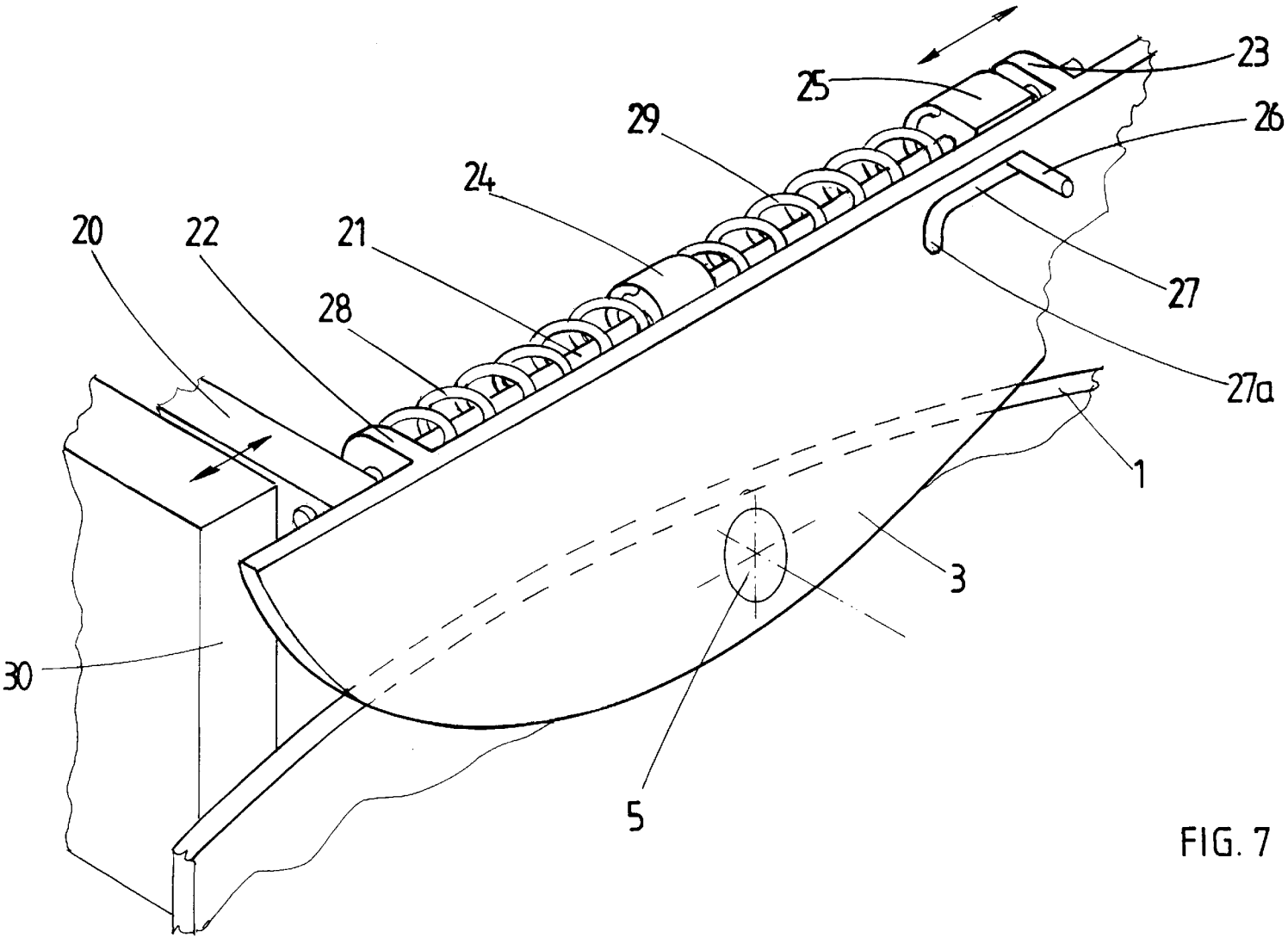
FIG. 7 is a partial perspective view of a second embodiment.

A second embodiment is represented in FIG. 7. Apart from the wedging means, the skate according to this second embodiment is identical with the skate according to the first embodiment. For this reason, only that part of the skate where the wedging member is located has been represented. References 1 and 3 again respectively denote the lower chassis and the upper chassis, which are articulated about a pin 5. The boot has not been represented, in order to show the wedging device clearly. This device consists of a wedge 20, of right parallelepipedal shape in the particular embodiment which is represented, this wedge being fixed to the end of a shaft 21 which is mounted so as to slide longitudinally in the upper chasis 3 in two brackets 22 and 23 secured to the upper chassis 3. In its central part, the shaft 21 is provided with a stud 24 secured to the shaft 21. On the shaft 21, near to its end opposite the wedge 20, a mobile stop 25 is secured to a radial arm control member 26 and mounted so as to slide on the shaft 21, this stop being provided with a radial arm 26 which passes through an L-shaped slot 27 cut in the flank of the upper chassis 3, the slot permitting the repositioning of the radial arm. A first helical spring 28 is mounted around the shaft 21, between the bracket 22 and the stud 24. A second helical spring 29 is mounted between the stud 24 and the mobile stop 25. The springs 28 and 29 are antagonistic delayed-action positioning springs working in compression, such as is known in the mechanical arts. The lower chassis 1 has a support part 30 intended to interact with the eedge 20.

The adjusting device consists of (1) a first annular cylindrical part 31 having a crennelated recess 36, (2) a radial arm 41 for angular drive and positioning, and (3) of a second annular cylindrical part 32 in the form of a cylinder cam, fitted into the first annular part and mounted so as to rotate about an approximately vertical axis in the first part. This second annular part 32 has levels 43, 39 and 40 and a crennelated recess 44 which is similar to the recess 36 of the first part and is located in front of this recess. The delayed-action positioning spring is a torsion spring 33 whose ends bear respectively against each of the sides of the crennelated recesses 36 and 44 of the two parts, so that in the event of a new preselection of the adjustment device, the second part 32 is brought by the spring 33 into the preselected position when the second part is released.

In the position represented in FIG. 7, the inclination of the upper chassis 3 is a maximum, that is to say as represented in FIG. 3. The wedge 20 is located to the rear of the support part 30 and is inoperative. The stud 24 is half-way between the stops 22 and 25, and since the springs 28 and 29 are identical, the shaft 21 is in equilibrium.

In order to change from the high-inclination position to the low-inclination position of the upper chassis 3, it is sufficient to bring the arm 26 of the mobile stop 25 to the bottom of the short vertical part 27*a* of the slot 27. This has the effect of compressing the springs 28 and 29, and the wedge 20 comes to abut laterally against the support part 30. It is thus prepositioned. The lowering of the upper chassis 3, under the effect of the skater's weight, has the effect of raising the wedge 20 to the level of the support part 30, and under the effect of the springs 28 and 29, the system will return to an equilibrium position and the wedge 20 will be placed on the support piece 30. The upper chassis 3 is then in its low-inclination position, corresponding to the position represented in FIG. 1.

The upper chassis 3 is returned into the high-inclination position by using the delayed action of the spring 28. The arm 26 is returned into the position represented in FIG. 7, which has the effect of prepositioning the wedge 20. As soon as the latter has been released, that is to say as soon as the frictional forces between the wedge 20 and the support part 30 become sufficiently small, the spring 28 pushes back the shaft 21, which returns to its position represented in FIG. 7.

The shaft 21 could, of course, be arranged in the median plane of the upper chassis and be supported by two spacers.

Figure 10:
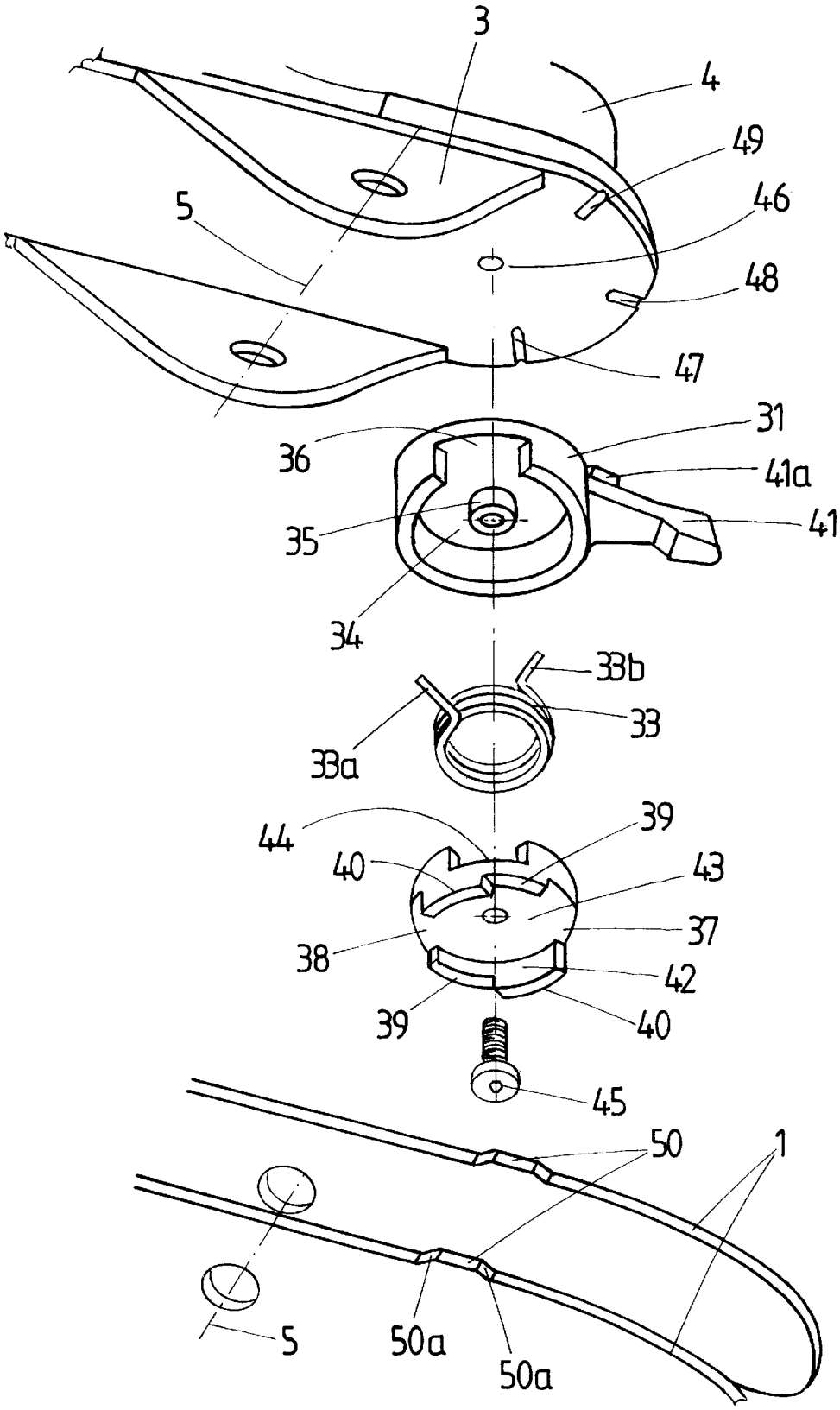
FIG. 10 is an exploded view of the wedging member in FIG. 9.

The first and second embodiments only allow two different inclinations of the upper chassis to be obtained. FIGS. 8 to 10 illustrate an embodiment comprising wedging means making it possible to obtain three different inclinations. In this third embodiment, the two chassis 1 and 3 are substantially the same as in the previous embodiments. The device for adjusting the inclination is again mounted on the upper chassis 3, directly below the boot 4. This adjustment device consists of a first cylindrical part 31, a second cylindrical part 32 and a torsion spring 33 mounted between the parts 31 and 32. The first part 31 is in the form of a cup provided with a bottom 34, at the center of which a bush 35 protrudes. The cylindrical portion of the part 31 is interrupted by a crennelated recess 36 whose aperture angle corresponds to the angle formed by the two arms 33*a* and 33*b* of the spring 33. The second part 32 is housed so that it can rotate in the part 31. The second part 32 is in the form of a cylindrical cover 42 which has a diameter equal to the overall width of the lower chassis 1, surrounds a central disc 43 and, on the side facing the bottom 34 of the part 31, has a crennelated recess 44 that has the same angular width as the recess 36 of the part 31 and coincides with the recess 36, so that the arms 33*a* and 33*b* of the spring 33 bear both on the sides of the recess 36 and on the sides of the recess 44. On the opposite side from the recess 44, the cylindrical cover 42 has two deep crennelated recesses 37 and 38, the bottoms of which are level with the disk 43. In the manner of cylinder cam, the cylindrical cover of the part 32 also has two other levels 39 and 40, these being arranged in pairs and diametrically opposite. The part 31 is provided with a flexible arm 41 provided with a projection 41*a,* like the arm 12 in the first embodiment.

The adjustment device is mounted so that it can rotate in the upper chassis 3 about an approximately vertical axis 55, about a screw 45 that passes through the disk 43 and the bush 35 and is screwed into a hole 46 in the upper chassis 3. The upper chassis 3 has three notches such as 47, 48, 49, into which the projection 41*a* of the arm 41 can be engaged in order to position this arm, that is to say in order to position the part 31 of the adjustment device. In a first angular position of the part 32, that is to say the position represented in FIG. 9, the arm 41 being retained in the notch 47, the lower chassis 1 bears on the level 40 of the part 32 via bosses 50. In this position, the upper chassis has a minimum inclination as represented in FIG. 8. In order to move from this minimum inclination to a medium inclination, the adjustment device is prepositioned by bringing the arm 41 into the notch 48. Since the part 32 is retained by the lower chassis, this operation has the effect of bringing the arm 33*b* of the spring close to the arm 33*a,* that is to say of arming this spring. Pressure on the spring 6 releases the part 32, which is rotated by the relaxation of the spring 33, that is to say by the thrust of its arm 33*a*. The lower chassis 1 can then come to bear on the level 39.

The change to the position of maximum inclination takes place in the same way by bringing the arm 41 into the notch 49. Releasing the part 32 allows it to be rotated by the spring 33 and the chassis 1 can come to bear in the bottom of the crennelated recesses 37 and 38. Return to the medium inclination then to the minimum inclination takes place in the same way. The bosses 50 are laterally provided with ramps 50*a* which make it easier to move from one level to another.

We claim:

1. An in-line roller skate comprising an upper chassis (3) on which a boot (4) is fixed, and a lower chassis (1) which bears at least two rollers (2) and onto which the upper chassis is articulated about a pin (5) parallel to the axes of the rollers and located between and including the middle and the front end of the lower chassis, and an elastic means (6) which counteracts the downward movement of the upper chassis and is located between the two chassis, which skate includes, in front of the articulation pin of the two chassis, a device for adjusting the maximum inclination of the upper chassis having delayed action, this device consisting of a wedging member (8; 20; 32) capable of occupying at least two different wedging positions, at least one spring (13; 28, 29; 33) for positioning the wedging member, and a manual prepositioning means (12; 26; 41), actuation of which causes arming of the said spring so long as the wedging member is retained by one of the chassis, so that the wedging member is brought into a prepositioned position by relaxation of the positioning spring when it is released by compression of the said elastic means (6) under the effect of the skater's weight.

2. The skate as claimed in claim 1, wherein the said wedging member consists of a stop (8) that can move on the lower chassis, wherein the positioning spring (13) bears via one end on the mobile stop, wherein a control member (12) is mounted on the lower chassis and acts on the other end of the spring (13), and wherein the lower chassis has means (16, 17) for positioning and retention, against action of the spring (13), of the control member (12) in two determined positions, namely a first position (16), in which the spring (13) is armed so as to bring the stop (8) into a wedging position for the upper chassis in a down position where it is released by the upper chassis, and to hold it in this wedging position, and a second position (17), in which the spring (13) is armed so as to move the stop (8) away from the upper chassis when it is released by the upper chassis and to hold it in this position.

3. The skate as claimed in claim 2, wherein the stop (8) consists of a plate mounted so as to tilt on the lower chassis, wherein the control member is a rotary member (12) provided with a pin (11) engaged in the stop, wherein the spring (13) is a torsion spring, one end of which is engaged in the stop and other end of which is engaged in the rotary member, and wherein the means for retention of the control member consist of notches (16, 17) formed in the lower chassis.

4. The skate as claimed in claim 1, wherein the wedging member (20) is secured to a shaft (21) mounted so as to slide longitudinally in the upper chassis (3), provided with a stud (24) in its central part and surrounded by two antagonistic delayed-action positioning springs (28, 29) working in compression between the said stud and, on one side, a fixed bracket (22) secured to the upper chassis and, on the other side, a mobile stop (25) secured to a control member (26), means (27) being provided in the upper chassis in order to preposition the control member.

5. The skate as claimed in claim 1, wherein the adjusting device consists of a first annular cylindrical part (31) having a crennelated recess (36) and a radial arm (41) for angular drive and positioning, and of a second annular cylindrical part (32) in the form of a cylinder cam, fitted into the first annular part and mounted so as to rotate about an at least approximately vertical axis in the first part, this second annular part (32) having at least two levels (43, 39, 40) and a crennelated recess (44) which is similar to the recess (36) of the first part and is located in front of this recess, and wherein the delayed-action positioning spring is a torsion spring (33) whose ends bear respectively against each of the sides of the crennelated recesses (36, 44) of the two parts, so that in the event of a new preselection of the adjustment device, the second part (32) is brought by the spring (33) into the preselected position when the second part is released.

* * * * *